United States Patent [19]

Gendron et al.

[11] 4,098,355

[45] Jul. 4, 1978

[54] UNDERWATER HAMMER WITH CIRCUMFERENTIAL FLOW SEAL

[75] Inventors: George J. Gendron; Henry A. Nelson Holland, both of Houston, Tex.

[73] Assignee: Raymond International Inc., Houston, Tex.

[21] Appl. No.: 763,085

[22] Filed: Jan. 27, 1977

[51] Int. Cl.[2] ..... E02D 7/10

[52] U.S. Cl. ..... 173/127; 173/135; 173/DIG. 1; 61/53.5

[58] Field of Search ..... 61/53.5; 173/126–137, 173/DIG. 1

[56] References Cited

U.S. PATENT DOCUMENTS

| | | | |
|---|---|---|---|
| 2,580,203 | 12/1951 | Topanelian | 173/73 |
| 2,862,475 | 12/1958 | Kinsman | 173/136 X |
| 3,037,208 | 6/1962 | Haberstump | 173/169 X |
| 3,095,046 | 6/1963 | Mori | 173/136 |
| 3,314,241 | 4/1967 | Mayhall | 61/53.5 |
| 3,417,828 | 12/1968 | Duyster et al. | 175/19 |
| 3,606,297 | 9/1971 | Webb | 267/125 |
| 3,646,598 | 2/1972 | Chelminski | 61/53.5 |
| 3,788,402 | 1/1974 | Chelminski | 173/91 |
| 3,797,585 | 3/1974 | Ludvigson | 173/131 |
| 3,817,335 | 6/1974 | Chelminski | 173/127 |
| 3,881,557 | 5/1975 | Gendron et al. | 173/DIG. 1 |
| 3,958,647 | 5/1976 | Chelminski | 173/127 |

FOREIGN PATENT DOCUMENTS

| | | | |
|---|---|---|---|
| 1,440,956 | 6/1976 | United Kingdom | 173/134 |
| 186,336 | 1/1967 | U.S.S.R. | 173/134 |
| 452,648 | 4/1975 | U.S.S.R. | 173/134 |

*Primary Examiner*—Lawrence J. Staab

*Attorney, Agent, or Firm*—Fitzpatrick, Cella, Harper & Scinto

[57] ABSTRACT

An underwater hammer, of the gas discharge type, is provided with a circumferential control valve on the hammer ram to allow free flow of water and gas upwardly along the ram in the annular clearance between the ram and a tubular sleeve in which it is guided, but to interrupt the flow of water downwardly along the ram. The control valve allows the region under the ram to be purged of water when the ram is driven upwardly in the sleeve and it prevents water thereafter from flowing back down under the ram where it would otherwise cushion ram impact on an anvil.

27 Claims, 14 Drawing Figures

40
48
44
58
54
50
51
62
53
46
52
42
45
60
56
59
A

A
B
C
D
E
F
40
42
44
45
46
48
50
51
52
53
64

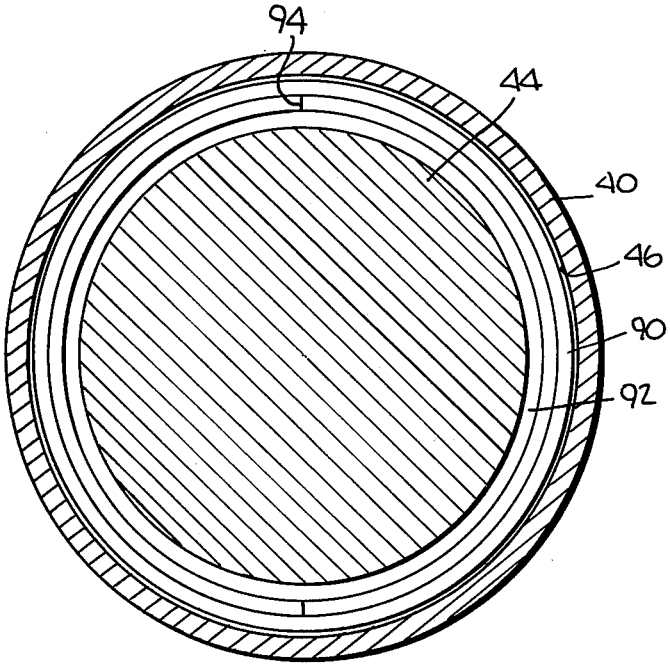
Fig.11.
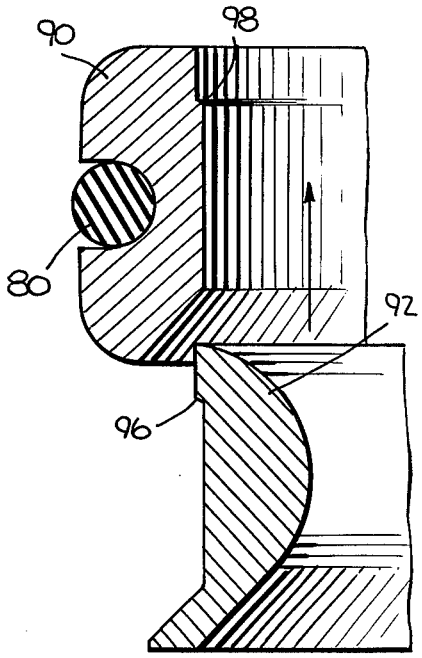
Fig.12.
Fig.13.
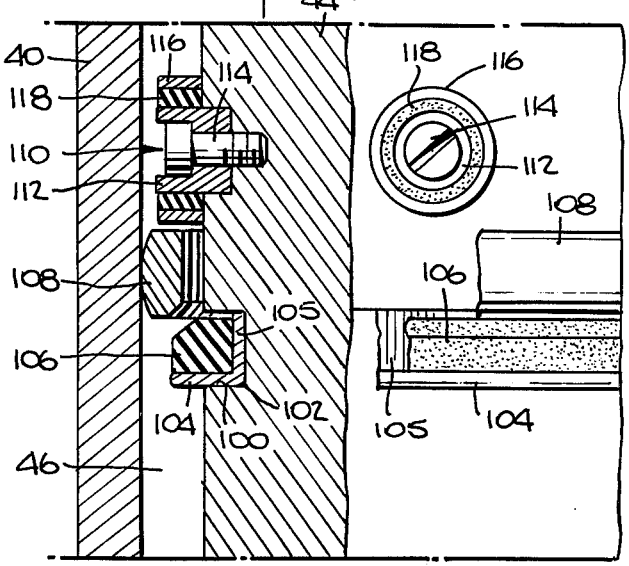
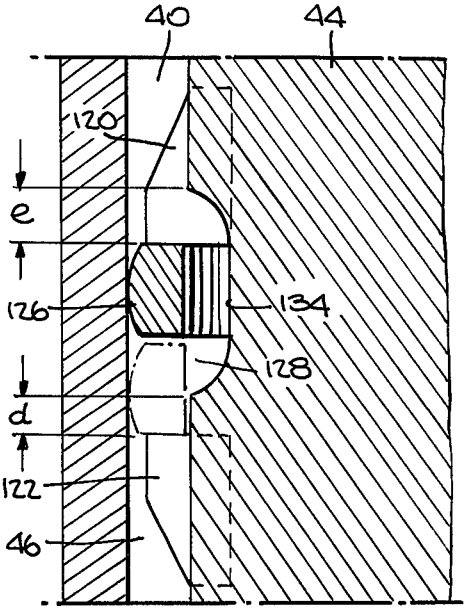
Fig.14.

UNDERWATER HAMMER WITH CIRCUMFERENTIAL FLOW SEAL

FIELD OF THE INVENTION

This invention relates to hammers in which a massive hammering ram is driven upwardly in a sleeve and then is allowed to fall back down on an anvil and, more particularly, it concerns novel improvements for improving the performance of said hammers in underwater hammering operations.

BACKGROUND OF THE INVENTION

1. Description of the Prior Art

U.S. Pats., No. 3,646,598, No. 3,817,335 and No. 3,958,647, all in the name of Stephen V. Chelminski, relate to gas discharge type underwater hammers which are improved by the present invention. Each of these hammers includes a vertical tubular sleeve inside of which a massive ram is guided for up and down movement. An anvil is positioned under the ram and is attached to the top of a pile or other element to be driven. A gas discharge device, capable of storing up and suddenly releasing a burst of high pressure gas, is positioned inside the sleeve under the ram. When the gas discharge device is triggered the sudden release of high pressure gas drives the ram upwardly in the sleeve. The ram then falls back onto the anvil and the impact drives the anvil and pile or other element downwardly.

The ram is guided in the tubular sleeve by means of spaced apart sliding shoes mounted on the ram; and the ram circumference itself is smaller than the inside of the sleeve so that an annular clearance exists between the ram and the sleeve. This annular clearance gives rise to problems in that, when the hammer is operated, water will flow down through the annular clearance and onto the anvil while the ram is in flight. Then, when the ram falls back down on the anvil it becomes cushioned by the layer of water resting on the anvil impact surface; and, as a result, a sharp hammer blow is not delivered and the effectiveness of the hammer in driving the pile is less than it would be if the ram were allowed to impact on an anvil surface which was essentially free of water.

SUMMARY OF THE INVENTION

The present invention overcomes the above described problem of the prior art and provides arrangements which allow the ram of an underwater gas discharge type hammer to impact against an essentially water free anvil surface so that a sharp blow is delivered to the anvil.

According to the present invention there is provided in an underwater hammer, as above described, novel circumferential valve means which extends around the annular clearance between the ram and the sleeve. This novel valve means is constructed and arranged to allow substantially free flow of water and gas in a direction upwardly with respect to the ram but to restrict the flow of water in a direction downwardly with respect to the ram. When the gas discharge device is triggered, water from under the ram is driven upwardly through the annular clearance past the circumferential valve means. Thereafter, as water tends to flow back down through the annular clearance, the valve means closes and prevents the back flow of water down past the ram.

The ram and the sleeve constitute a pair of members which together define the annular clearance; and the valve means is constructed on one of these members. The valve means itself comprises an annular seat extending around the annular clearance on one of the members and exposed to the other member. A passageway is formed in the one member above the valve seat and a valve ring is arranged to fit in the clearance and to move up and down out from and in to seating, sealing engagement with the valve seat. The valve ring extends across the clearance and into sliding, sealing engagement with the other member. Upward flows of fluid in the annular clearance lift the valve ring up off the seat and open the passageway in the one member so that fluid may flow freely up through the passageway. On the other hand, when fluid tends to flow downwardly relative to the valve, the ring is forced against the valve seat to prevent flow down through the annular clearance.

The present invention, in various aspects thereof, provides different arrangements for achieving the above described valve action.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

Several embodiments of the invention have been chosen for purposes of illustration and description, and are shown in the accompanying drawings, forming a part of the specification, wherein:

FIG. 11 is a full cross section view taken along line 11—11 of FIG. 10;

FIG. 12 is an exploded view showing the construction and assembly of a composite valve ring used in the modification of FIG. 10;

FIG. 13 is a view similar to FIG. 10 and showing a fourth modification of the circumferential valve with the valve in unsealed condition; and FIG. 14 is a view similar to FIG. 10 and showing a fifth modification of the circumferential valve with the valve in unsealed condition.

DETAILED DESCRIPTION

Figure 1:
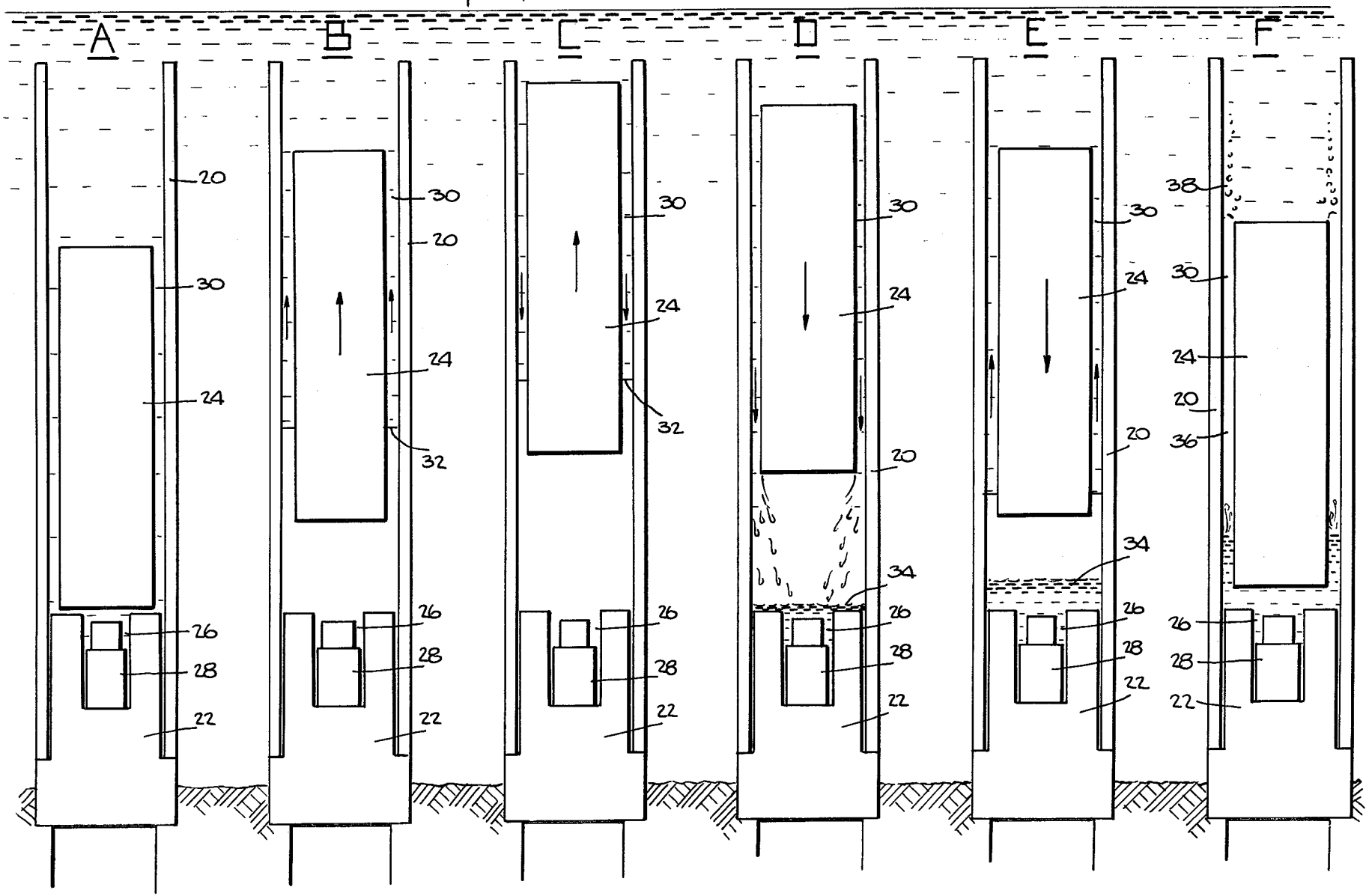
Fig. 1. PRIOR ART
FIG. 1 A–F is a series of diagrammatic representations of an underwater gas discharge hammer of the prior art illustrating its cycle of operation and illustrating the problem overcome by the present invention.

The prior art underwater gas discharge hammer shown in FIG. 1A comprises a tubular metal sleeve 20, an anvil 22 which fits closely inside the lower end of the sleeve and a massive cylindrical ram 24 which is positioned inside the sleeve and is guided thereby for up and down movement to hammer against the anvil 22. The anvil 22 may rest against a pile cap block (not shown) or other suitable device for transferring the energy of hammer blows of the ram on the anvil to a pile or other member to be driven.

The anvil 22 is formed with a central recess 26 in its upper end and a gas discharge device 28 is mounted in this recess. The gas discharge device 28 is in open communication with the bottom of the ram 24 but is low enough in the recess 26 so as not to become contacted by the ram when it falls on the anvil.

The gas discharge device 28 operates to produce sudden releases of high pressure gas or air in a controlled manner to drive the ram 24 upwardly in the sleeve 20. Devices capable of producing such controlled sudden release of high pressure gas or air are sold under the trademark PAR AIR GUN by Bolt Associates Inc. of Norwalk, Connecticut. U.S. Pat. No. 3,249,177 also describes a suitable gas discharge device.

The sequence or cycle of operation of the prior art underwater gas discharge hammer is illustrated in FIG. 1 A–F. As can be seen in FIG. 1A, the internal diameter of the sleeve 20 is larger than the outer diameter of the ram 24 to permit the ram to move freely up and down therein. This difference in diameter defines a circumferential clearance 30 between the ram and the sleeve; and when the hammer is in its submerged operating condition as shown, water flows down through this clearance, under the ram and into the anvil recess 26 as shown in FIG. 1A.

The hammer operation is initiated by triggering or detonating the gas discharge device 28 so that it releases a sudden burst of high pressure gas or air into the region under the ram 24.

The pressure of the gas released from the discharge device 28 overcomes the ambient pressure caused by the head of water in which the hammer is submerged; and it overcomes the weight of the ram itself. Accordingly, the ram is driven upwardly by the sudden gas release; and at the same time the water under the ram is also driven upwardly through the clearance 30 as shown in FIG. 1B. The water, being less dense than the ram, undergoes greater acceleration and so there is formed a gas-water interface 32 which moves upwardly in the clearance 30. The region below the interface 32 is essentially free of water. The water in the clearance 30 above the interface 32 serves as a pressure seal so that the ram 24 will be driven as high as possible for a given magnitude of explosive energy from the gas discharge device 28.

As the ram and water move upwardly in the sleeve 20 the air space under the ram increases in size and as a result the pressure under the ram decreases. Eventually this pressure is insufficient to continue to drive the ram and water upwardly. Again, however, since the water is less dense and has less inertia than the ram, it begins to descend before the ram whose momentum continues to carry it upward as shown in FIG. 1C. As a result the air-water interface 32 moves rapidly downward relative to the ram. This downward movement becomes accelerated because the ram, which is still moving upwardly, has a much larger displacement than the clearance 30 so that the portion of the ram's upward movement which is due to momentum causes a negative pressure in the air space under it and this negative pressure draws the air-water interface downwardly at a very rapid rate.

Eventually the ram 24 loses its upward momentum and begins to fall back downwardly as shown in FIG. 1D. However this initial downward movement is not as rapid as the downward movement of the air-water interface 32 and consequently the interface reaches the bottom of the ram before the ram reaches the anvil. When this occurs the water in the clearance 30 begins to fall back down into the region below the ram and onto the anvil 22 to form a cushion of water 34 as shown in FIG. 1D.

As the ram continues to fall back down toward the anvil at increasing velocity its displacement causes an increase in pressure in the space below it. This increase in pressure serves to prevent further movement of water down from the clearance 30; and, in fact, it actually causes the air-water interface to be driven back upwardly with respect to the ram as shown in FIG. 1E. This pressure increase, however, does not have any effect on the cushion of water 34 resting on top of the anvil. Thus when the ram falls back down, as shown in FIG. 1F, it does not strike the anvil 22 sharply but instead it strikes the cushion of water 34 and dissipates a substantial portion of its energy in driving the water cushion up through the clearance 32. The presence of the cushion of water 34 also affects the impedance match between the hammer and the anvil in that it produces an effect akin to interposing a spring on top of a nail when it is being hammered. As can also be seen in FIG. 1F the movement of the cushion of water 34 up into the clearance 30 at impact serves to seal off the region under the ram from the air which was driven up around it just before impact. As a result there is formed a circumferential air pocket 36 in the clearance 30. The air in this air pocket progresses upwardly and vents to the surface of the water in the form of bubbles 38.

Figures 2, 3, 4, 5:
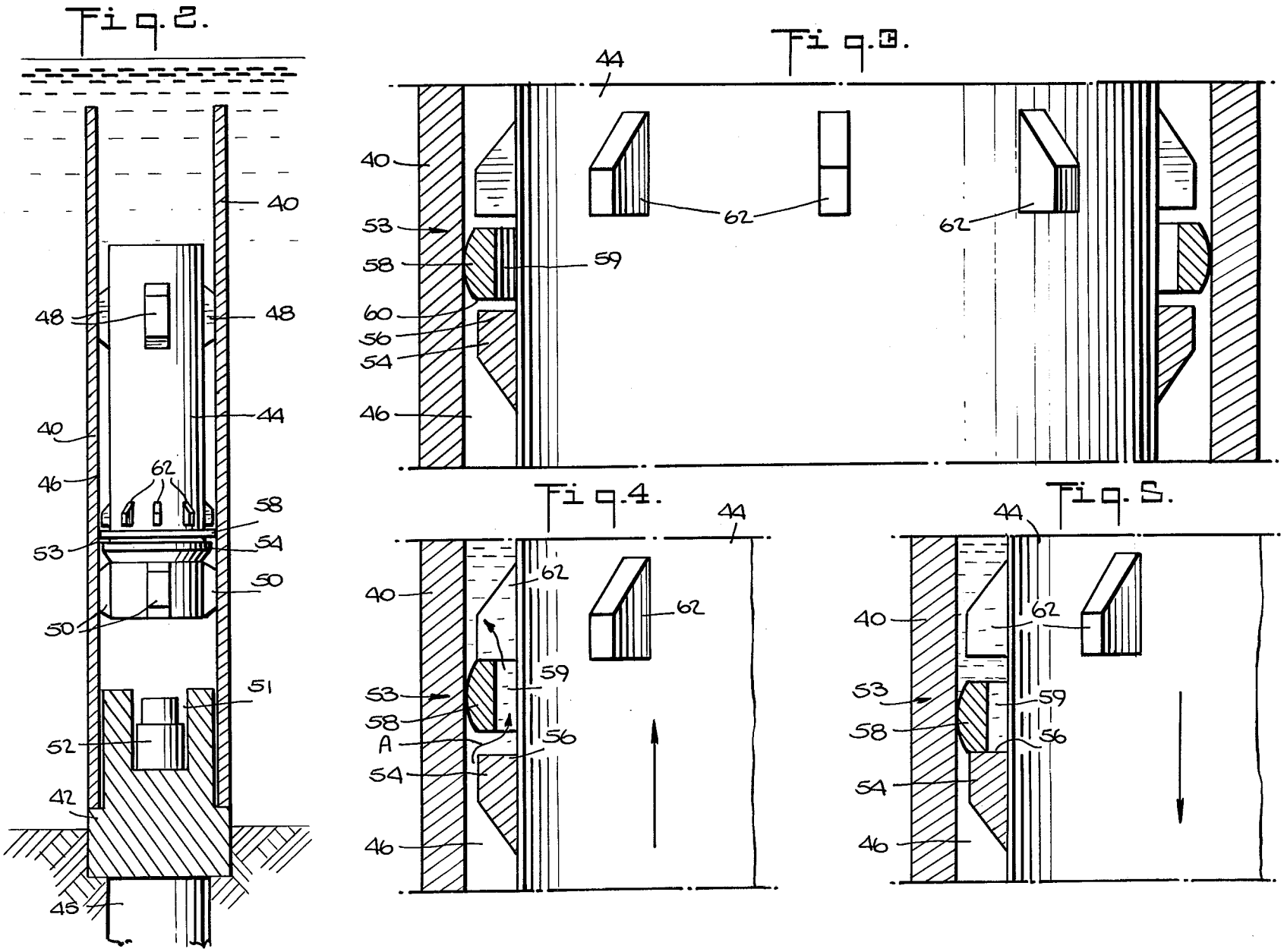
FIG. 2 is an elevational view, taken in section, of an underwater gas discharge hammer in which the present invention is embodied.
FIG. 3 is an enlarged fragmentary view of a portion of the hammer of FIG. 2, showing a circumferential control valve in accordance with the present invention.
FIG. 4 is a further fragmentary view showing the circumferential control valve of FIG. 3 in an unsealed condition.
FIG. 5 is a view similar to FIG. 4 showing the circumferential control valve in sealed condition.

FIGS. 2–5 illustrate the hammer construction of the present invention. As shown in FIG. 2, the hammer construction of the present invention comprises a tubular sleeve 40 and an anvil 42 similar in construction to the sleeve and anvil 20 and 22 of the prior art. A massive ram 44 is mounted to move up and down in the sleeve 40 to impact on the anvil 42. The anvil 42 is mounted on a pile 45 or other element to be driven into the earth or sea bed.

The ram 44 is of smaller diameter than the interior of the sleeve 40 and thereby defines with the sleeve an annular clearance 46. The ram 44 is also provided with upper and lower sets of spaced apart guide shoes 48 and 50 which slide against the inner surface of the sleeve 40 and hold the ram centered while it moves up and down in the sleeve.

The anvil 42 is formed with a central upwardly opening cavity 51 in which a gas discharge device 52 is positioned. The gas discharge device 52, as in the prior art, is triggered to suddenly release a charge of pressurized gas into the region under the ram 44 to drive it upwardly in the sleeve 40. The ram thereafter falls back down and impacts against the anvil 42 which in turn drives the pile 45 downwardly.

As shown in FIGS. 2 and 3, the ram 44 is provided near its lower end, i.e. adjacent the lower guide shoes 50, with a circumferential control valve 53 according to the present invention. While the control valve 53, as illustrated in the figures, is located above the lower guide shoes 50, it will be understood that it is also within the scope of the invention to position the valve below guide shoes 50. The control valve 53 includes an annular valve seat member 54 having a continuous, circumferential, flat upper lateral surface 56 (FIG. 3) which extends from the cylindrical outer surface of the ram 44 part way across the annular clearance 46. A valve ring 58 extends around the ram 44 just above the valve seat member 54. The outer diameter of the valve ring 58 is equal to or slightly smaller than the inner diameter of the tubular sleeve 40 and is in sliding, sealing relation therewith. That is, the ring 58 can easily slide up and down in the sleeve while substantially preventing water flow between itself and the sleeve. The inner diameter of the valve ring 58 is substantially larger than the diameter of the ram 44 to form an annular passageway 59 through which water and gas may freely flow. The inner diameter of the valve ring 58, however, is less than the outer diameter of the valve seat member 54; and it has a lower lateral surface 60 which can seat upon the upper lateral surface 56 of the valve seat member 54 to effect a seal which prevents flow of water past the lower end of the passageway 59.

A plurality of spaced apart retaining lugs 62 are mounted on the ram 44 at a finite distance above the valve ring 58. These lugs extend outwardly from the ram 44 a sufficient distance to engage the top of the valve ring 58 and limit its upward movement with respect to the ram and the valve seat member 54. It will be appreciated that the spacing between the valve seat member 54 and the retaining lugs 62 is such that the valve ring 58 can move up and down a limited but finite amount with respect to the ram 44 and the valve seat member 54. The retaining lugs 62 thus define a fluid flow passageway above the valve seat.

Turning now to FIG. 4, it will be seen that when the valve ring 58 abuts against the retaining lugs 62 its lower lateral surface 60 is a finite distance up off the upper lateral surface 56 of the valve seat member 54 to open the passageway 59 so that water and gas can pass freely up past the valve as indicated by the arrow A. Thus water and gas may flow freely along the annular clearance 46 around the outside of the valve seat member 54, through the annular passageway 59 inside the valve ring 58 and upwardly between the retaining lugs 62. On the other hand, when the valve ring 58 is in its lower position as shown in FIG. 5 its lower lateral surface 60 effects a seal with the upper lateral surface 56 of the valve seat member so that the passageway 59 becomes closed and flow of liquid along the annular clearance 46 is interrupted.

The valve ring 58 is moved up and down between its opened and closed positions by the fluid forces imposed on it. Thus when water tends to flow upwardly through the annular clearance 46 with respect to the ram 44, the valve ring 58 is pushed to its uppermost position, as shown in FIG. 4, to allow free flow of the water and gas. On the other hand, when water tends to flow downwardly through the annular clearance 46 with respect to the ram 44, the valve ring 58 is pushed to its lowermost position, as shown in FIG. 5, to interrupt flow of water. In short, the valve ring 58 cooperates with the valve seat member 54 to allow free upward flow but no downward flow of water with respect to the ram 44.

Figure 6:
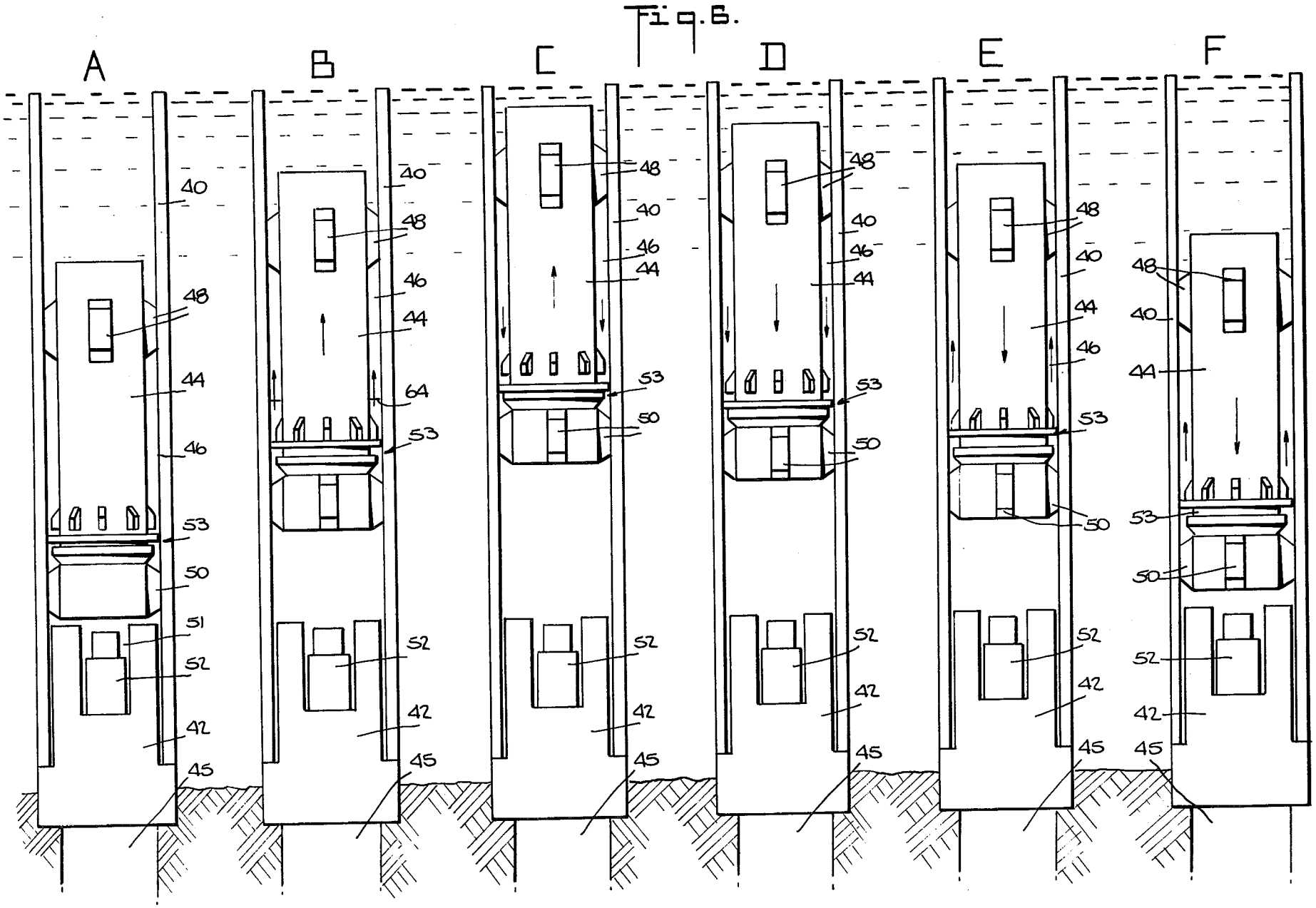
FIG. 6 A–F is a series of diagrammatic representations of an underwater gas discharge hammer of the present invention and illustrating its cycle of operation and the manner in which it overcomes the problems of the prior art.

The effect of the above described valve ring and seat arrangement on the operation of the gas discharge hammer will now be described in conjunction with FIG. 6 A–F. As shown in FIG. 6A, hammer operation begins with the ram 44 resting on the anvil 22. At this time the cavity 51 is flooded with water, as is the entire region inside the tubular sleeve 40 including the annular clearance 46. At the start of a cycle of operation the gas discharge device 52 is traggered so that it releases a sudden burst of high pressure gas or air into the region under the ram 44. The ram is driven upwardly by this burst as shown in FIG. 6B. At the same time, the water under the ram is also driven upwardly through the annular clearance 46 as indicated by the arrows B in FIG. 6B. The water, being less dense than the ram, undergoes greater acceleration than the ram so that a gas-water interface 64 is formed which moves upwardly with respect to the ram in the annular clearance 46. As explained above, the valve ring and seat arrangement permits upward air and water movement through the clearance 46 with respect to the ram 44. Further, the water in the clearance 46 above the gas-water interface 64 serves as a pressure seal so that the ram will be driven as high as possible.

As the ram and water move upwardly in the sleeve 40 the air space under the ram increases in size; and, as a result, the pressure under the ram decreases. Eventually this pressure becomes insufficient to continue to drive the ram and water upwardly. Again, however, since the water is less dense and has less inertia than the ram, it begins to descend before the ram. The ram in turn, because of its high inertia and momentum, continues to move upwardly as shown in FIG. 6C. As a result, the gas-water interface 64 begins to move rapidly downward relative to the ram. This relative movement continues until the water in the annular clearance 46 reaches the valve ring 58. The water then pushes the valve ring 58 down against the valve seat member 54 to close the passageway 59 (FIG. 4). Consequently no appreciable amount of water falls back down past the bottom of the ram. Eventually the ram 44 loses its upward momentum and begins to fall back down through the sleeve 40 as shown in FIG. 6D. Initially this downward movement is slow; and the weight of the water on the upper side of the valve ring 58 holds it tight against the valve seat element 54. However, as the ram continues to fall back down toward the anvil, the pressure of the air below the ram increases as a result of volume reduction until a sufficient pressure is established to cause the gas-water interface to being moving upwardly again relative to the ram as shown in FIG. 6E. At this point the valve ring 58 may lift off the valve seat member to allow upward movement of the air displaced by the downwardly moving ram, as shown in FIG. 6F. This serves to reduce cushioning effects caused by air or gas trapped under the ram, so that the ram can deliver a sharp, unobstructed blow on top of the anvil 42. Means (not shown) may be provided for selectively flooding the cavity 51 after the ram has struck the anvil. Such means may include, for example, an axial passageway through the ram as described in U.S. Pat. Nos. 3,817,335 and 3,958,647.

Figure 7:
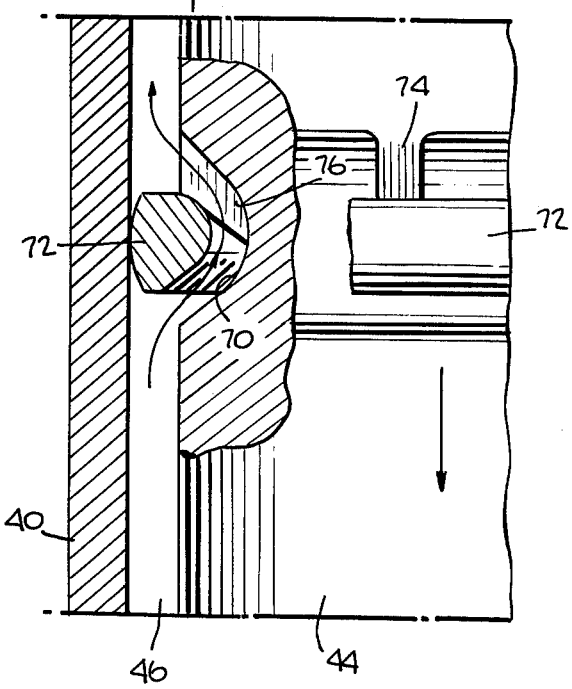
FIGS. 7 and 8 are views similar to FIGS. 4 and 5, and showing a first modification of the circumferential control valve in unsealed and sealed condition respectively.
Figure 8:
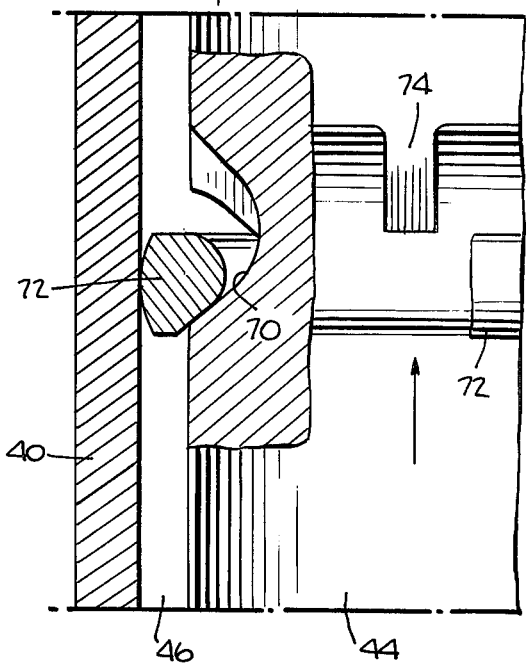

Under some operating conditions it may be desired to provide a circumferential valve arrangement around the ram which, when open, defines a passageway having a cross sectional area at least as large as that of the annular clearance 46. The embodiment of FIGS. 7 and 8 provides a valve passageway of any desired cross sectional area. As shown in FIG. 7, the ram 44 itself is formed with a circumferential groove 70 of generally V-shaped cross section. A circumferential valve ring 72, of smaller but generally correspondingly shaped cross section, is fitted to extend part way into the groove 70. A plurality of spaced apart retaining lugs 74 project part way down into the groove 70 from its upper side. These lugs engage the upper side of the valve ring 72 and limit the upward movement of the ring so that it cannot seat against the upper side of the groove 70. The lugs 74, however, do allow the valve ring to lift up off the lower side of the groove 70 so that a flow passageway 76 is defined therebetween when the ring 72 is up against the lugs as shown in FIG. 7. This flow passageway can be made to have a cross section at least as great as that of the annular clearance 46. When the ring 72 falls back down to engage the lower side of the groove 70, it closes the passageway 76 and forms a seal with the ram 44, as shown in FIG. 8. The outer circumference of the ring 72 is dimensioned to fit closely inside the tubular sleeve 40 to provide a substantial seal therewith while at the same time allowing free sliding movement therealong.

Figure 9:
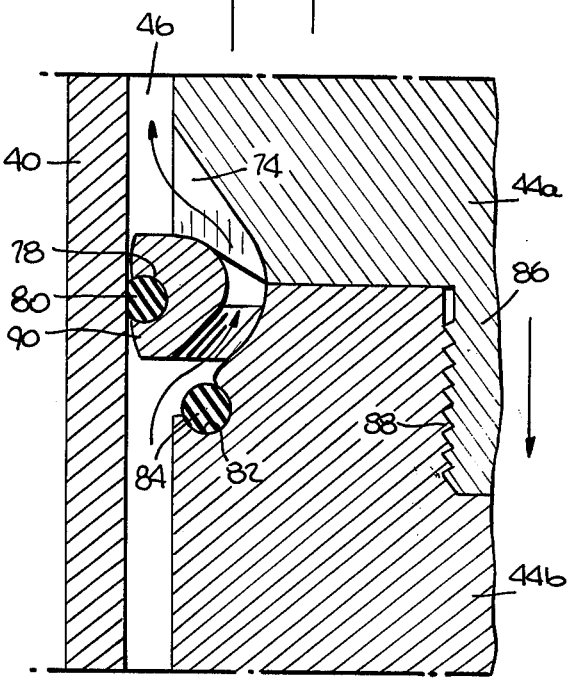
FIG. 9 is a view similar to FIG. 7 and showing a second modification of the circumferential control valve with the valve in unsealed condition.

FIG. 9 shows a modified version of the circumferential valve arrangement of FIGS. 7 and 8. In the FIG. 9 version, a modified valve ring **72*a* is formed with an outer circular recess 78 into which an annularly shaped, elastomeric sealing member 80 is fitted for providing a sliding seal with the inner surface of the tubular sleeve 40. Similarly, the lower side of the ram groove 70 is formed with a circular recess 82 into which a second annularly shaped, elastomeric sealing member 84 is fitted for providing a seating seal between the ring 72 and the ram 44. The elastomeric sealing members 80 and 84 provide good sealing under sliding conditions; and they can accommodate slight dimensional irregularities in the ram, the sleeve and the sealing ring. Also, the sealing members 80 and 84** can be replaced without any need to replace the other, more expensive elements of the valve assembly.

FIG. 9 also shows a modification to the ram 44 which permits the ring 72 to be fitted easily into the groove 70. As shown in FIG. 9, the ram is divided, crossways, at the groove 70; to form an upper portion **44*a* and a lower portion 44*b*. The upper portion 44*a* is provided with a threaded projection 86 while the lower portion 44*b* is provided with a threaded recess 88. The valve arrangement is assembled by separating the upper and lower portions 44*a* and 44*b* of the ram and fitting the sealing member 84 into the recess 82 in the lower portion 44*b*. The valve ring 72*a* is then fitted with its own sealing member 80 and is then placed over the reduced diameter circumferential groove portion of one of the ram portions and the ram portions are then assembled by screwing the threaded projection 86 of the upper ram portion 44*a* into the threaded recess of the lower ram portion 44*b***.

Figure 10:
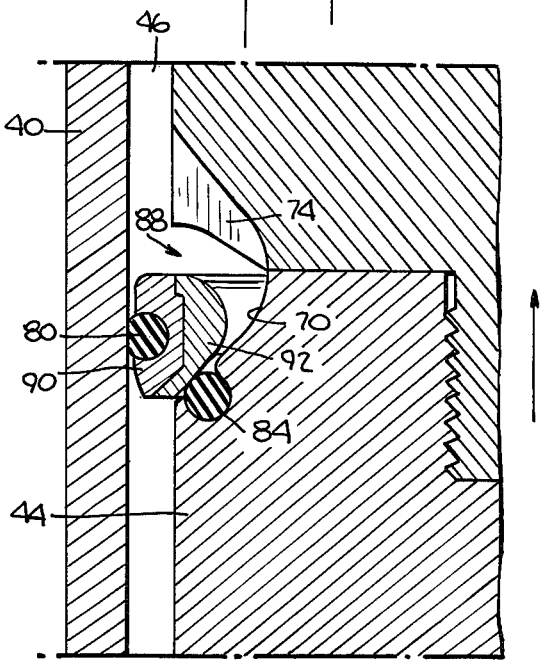
FIG. 10 is a view similar to FIG. 9 and showing a third modification of the circumferential control valve with the valve in sealed condition.

An alternative circumferential valve arrangement which does not require a two piece ram for assembly is shown in FIGS. 10–12. This alternative valve arrangement utilizes a circumferential groove 70 with lugs 74 as in the preceding embodiment. However, in this embodiment, as shown in FIG. 10, there is provided a composite valve ring 88 made up of an outer ring portion 90 and an inner ring portion 92. As shown in FIG. 11, the inner ring portion 92 is split at 94 to enable the ring portion 92 to be expanded slightly and fitted over the ram 44. When the inner ring portion 92 reaches the groove 70 it fits into the groove and can close back to its normal diameter. The normal dimensions of the inner ring portion 92 are such that its inner diameter is less than the ram diameter so that it fits into the groove 70 but allows sufficient clearance, when it abuts the lugs 74, to define a flow passageway of predetermined cross section. The inner ring portion 92 is also shaped to seal against the lower surface of the groove 70 to form a seal. As in the preceding embodiment, an elastomeric sealing member 84 may be provided to enhance this seal. The normal outer diameter of the inner ring portion 92 is slightly larger than the outer diameter of the ram 44. Also, as shown in FIG. 12, the inner ring portion 92 is formed with a shallow recess 96 for interlock with the outer ring portion.

The outer ring portion 90 is continuous, i.e. it is not split as is the inner ring portion 92. The outer diameter of the outer ring portion is equal to or slightly smaller than the inner diameter of the sleeve 40; and if desired an elastomeric sealing member 80 may be fitted onto it for establishing a free sliding seal with respect to the sleeve 40. The inner diameter of the outer ring portion 92 is slightly larger than the diameter of the ram 44; and it is formed with a shallow projection 98 which interfits with the recess 96 of the inner ring portion 92 (FIG. 12).

The composite valve ring 89 is assembled by expanding the inner ring portion 92 at the split 94 and drawing it down over the ram 44 until it reaches the groove 70 in the ram 44. The inner ring portion is then closed to its normal diameter and the outer ring portion 90 is drawn down over the ram 44 and is then pressed down over the inner ring portion, as shown in FIG. 12, until it snaps into place with its projection 96 fitted into the groove 94. The projection and groove are dimensioned to produce an interference fit in assembly so that the ring portions 90 and 92 will function as a single unitary structure.

A still further circumferential control valve construction is shown in FIG. 13. In this construction, the ram 44 is provided with a circumferential groove 100 of rectangular cross section; and a retaining ring 102 of right angle cross section is split and expanded to fit over the ram 44. The ring 102 comprises a support element and it includes a lateral shelf portion or flange 104 which projects slightly beyond the ram circumference when the ring is closed in the groove 100, as well as an upwardly extending portion 105 inside the groove. A valve seat ring 106 of elastomeric material, and having a generally rectangular cross section is then stretched over the ram 44 and drawn down until it seals on the flange shelf 104. The valve seat ring 106 is then allowed to contract to its normal dimensions so that it fits tightly into the groove 100 to engage the upwardly extending portion 105 and hold the support element ring 102 in place. A valve ring 108 is then fitted down over the ram 44. The valve ring 108 has an outer diameter which fits closely inside the sleeve 40 for sliding sealing movement. The inner diameter of the valve ring 108 is larger than the ram diameter to allow free fluid passage therebetween; but it is smaller than the outer diameter of the valve seat ring 106. This permits the valve ring to form a fluid seal when it rests on its valve seat ring 106.

A plurality of spaced apart retaining lug assemblies 110 are provided about the outer circumference of the ram 44 at a finite distance above the valve ring 108. Each assembly comprises a countersunk cylindrical plug 112 which is held by a threaded bolt 114 into a corresponding recess in the ram 44. A metal ring 116 surrounds the plug 112 and the space between the plug and ring is filled with a molded in place elastomeric material 118. This arrangement permits the valve ring 108 to be limited in its upward movement up off the valve seat ring 106; and at the same time the lugs with the elastomeric material 118 serve to cushion any sharp upward movements of the ring 108 due to sudden fluid flow changes.

FIG. 14 shows another circumferential control valve arrangement which permits the formation of an open valve passageway along the annular clearance 46 of any desired cross section. As can be seen in FIG. 14, there are provided upper and lower sets of restraining lugs 120 and 122 positioned in spaced apart relationship around the ram 44. A circumferential groove 124 is formed in the ram between the upper and lower sets of restraining lugs. The lower set of lugs 122 is located a distance "*d*" below the lower edge of the groove 124 while the upper set of lugs 120 extend down past the upper edge of the groove 124 by a second distance "*e*". A valve ring 126 is fitted down over the ram 44 before the upper set of lugs 120 is affixed to the ram. The valve ring 126 has an outer diameter such that it can slidingly seal with the tubular sleeve 40. The inner diameter of the ring 126 is larger than the upper end of the ram 44 so that it can easily be drawn down over the ram. However at least that portion of the ram between the lower edge of the groove 124 and the lower set of restraining lugs 122 has a diameter which is close enough to the internal diameter of the ring 126 to provide a close but free moving fit or overlap.

It will be seen that when the valve ring 126 is in its uppermost position as shown in solid outline in FIG. 14 a clearance 128 is defined between the valve ring 126 and the lower edge of the groove 124 to allow free upward flow of fluid along the annular clearance 46. Thereafter, when flow reverses and downward pressure force the valve ring 126 down against the lower set of restraining lugs 122 (as shown in phantom outline in FIG. 14), the valve ring overlaps the ram below the groove 124 and occupies the entire space between the ram 44 and the sleeve 40 so that fluid flow along the annular clearance 46 is interrupted.

It will be appreciated from the foregoing that in each modification of the circumferential control valve, water and gas may flow freely through the annular clearance 46 upwardly past the ram 44 so that the space beneath the ram can be evacuated when the gas discharge device is triggered; but when water tends to flow back downwardly past the ram before ram impact, such flow is interrupted by the circumferential control valve. As a result, the space under the ram may be flooded prior to triggering of the gas discharge device, so that effective driving of the ram may be obtained; and yet the space under the ram may be kept clear of water after the ram has been driven upwardly to ensure a sharp impact of the ram when it falls back down on the anvil.

Although particular embodiments of the invention are herein disclosed for purposes of explanation, various modifications thereof, after study of this specification, will be apparent to those skilled in the art to which the invention pertains.

What is claimed and desired to be secured by Letters Patent is:

1. A pressurized gas discharge hammer comprising an elongated tubular sleeve, a massive ram guided for movement up and down in the sleeve, said ram being dimensioned to allow a finite circumferential clearance between the ram and the sleeve, an anvil under the ram to receive impacts of said ram, said anvil and sleeve defining a region for retaining water therein, a pressurized gas discharge device located under said ram and operable to release charges of pressurized gas within the sleeve under the ram to drive the ram upwardly, and circumferential valve means extending around the ram in said circumferential clearance, said valve means being operative to allow substantially free flow of water and gas through said clearance upwardly with respect to said ram and to restrict flow of water through said clearance downwardly with respect to said ram.

2. A pressurized gas discharge hammer according to claim 1 wherein said circumferential valve means is mounted on said ram to move up and down with said ram.

3. A pressurized gas discharge hammer according to claim 2 wherein said circumferential valve means is located near the lower end of said ram.

4. A pressurized gas discharge hammer according to claim 3 wherein said ram is provided with upper and lower sets of spaced apart guide shoes which extend across said annular clearance and guide said ram in said sleeve.

5. A pressurized gas discharge hammer according to claim 4 wherein said lower set of guide shoes is located adjacent to said circumferential valve means.

6. A pressurized gas discharge hammer according to claim 1 wherein said circumferential valve means comprises means forming a continuous circumferential valve seat on one of said ram and said sleeve and exposed to said annular clearance, an annular ring fitted into said annular clearance and moveable up and down relative to said valve seat out of and in to seating engagement therewith, said ring extending across said clearance and engaging the other of said ram and said sleeve in sliding, sealing relationship and means associated with said one of said ram and said sleeve for defining a fluid passageway above said valve seat and around said valve ring.

7. A pressurized gas discharge hammer according to claim 6 wherein said means for defining a fluid passageway includes a plurality of spaced apart retaining lugs on said one of said ram and said sleeve and located in the path of upward movement of the valve ring to limit said upward movement.

8. An underwater hammer comprising an elongated tubular sleeve, a massive ram guided for up and down movement in the sleeve, an anvil positioned in the sleeve under the ram to receive impacts from the ram, means for driving said ram upwardly in the sleeve so that it can fall back on said anvil, said ram and said sleeve comprising a pair of members defining an annular clearance between them, valve means positioned within said clearance for permitting substantially free upward flow of water with respect to said ram while preventing downward flow of water with respect to said ram, said valve means including means forming a continuous valve seat on and extending around one of said members and exposed to said annular clearance, a valve ring located in said annular clearance and moveable up and down in said annular clearance with respect to said valve seat, out from and in to seating, sealing engagement therewith respectively, said valve ring, when in engagement with said valve seat, extending across said annular clearance and being in slideable, sealing engagement with said other member to prevent fluid flow through said annular clearance, said one member being formed with a fluid passageway above said valve seat to permit free fluid flow up through said annular clearance when said valve ring is up out of engagement with said valve seat.

9. An underwater hammer according to claim 8, wherein said fluid passageway comprises a circumferential groove formed in said one member and open to said annular clearance.

10. An underwater hammer according to claim 8 wherein said one member is said ram.

11. An underwater hammer according to claim 8 wherein said valve seat extends from said one member into said annular clearance.

12. An underwater hammer according to claim 9 wherein said valve seat comprises support element means having a lateral shelf extending from a circumferential groove in said one member part way across said annular clearance and an upwardly extending portion located inside said groove and a ring of elastomeric material resting on said lateral shelf and extending out into said annular clearance, said elastomeric material pressing against said upwardly extending portion to hold said support element means in place.

13. An underwater hammer according to claim 12 wherein said one member is said ram, wherein said support element means is a split ring which can be opened to fit down over said ram and into said groove and wherein said elastomeric material is stretchable over said ram.

14. An underwater hammer according to claim 8 wherein a plurality of spaced apart retaining lugs extend out from said one member into said annular clearance above said valve ring.

15. An underwater hammer according to claim 14 wherein said spaced apart retaining lugs comprise rings attached to said one member by means of fasteners said rings being secured to said fasteners by elastomeric means.

16. An underwater hammer according to claim 8 wherein said one member is formed with a circumferential groove, the lower outer edge thereof comprising said valve seat.

17. An underwater hammer according to claim 16 wherein said circumferential groove has an axial dimension greater than said valve ring so that said ring can move up and down a limited amount, the inner diameter of said groove being less than the inner diameter of said valve ring and comprising said fluid passageway.

18. An underwater hammer according to claim 17 wherein a plurality of spaced apart retaining lugs extend down from the upper edge of said groove to engage said valve ring and limit its upward movement in said groove.

19. An underwater hammer according to claim 9 wherein said one member is said ram and wherein said ram is separable at a transverse plane extending through the inner diameter of said groove.

20. An underwater hammer according to claim 19 wherein the separable portions of the ram are threadedly engaged with each other.

21. An underwater hammer according to claim 8 wherein said valve ring includes an elastomeric element around its edge in sealing, sliding engagement with said other member.

22. An underwater hammer according to claim 8 wherein said valve seat is an elastomeric element upon which said valve ring rests.

23. An underwater hammer according to claim 9 wherein said one member is said ram and wherein said valve ring comprises inner and outer ring portions in tight fitting relationship to each other with said inner ring portion extending part way into said groove and out beyond the circumference of said ram.

24. An underwater hammer according to claim 23 wherein said inner ring portion is split to expand over said ram and is closeable to fit into said groove and is held closed by tight fitting engagement with said outer ring portion.

25. An underwater hammer according to claim 8 wherein said valve seat is formed on a surface of said one member facing the other member, and wherein said valve ring has a diameter close to the diameter of said valve seat to slide down over said valve seat and wherein said one member is provided with sets of upper and lower elements arranged to limit the up and down movement of said valve ring.

26. An underwater hammer according to claim 8 wherein said ram has a valve seat surface facing said sleeve and an annular groove above said valve seat surface, said valve ring being slideable over said valve seat surface and up to said groove.

27. An underwater hammer according to claim 26 wherein said groove has a larger vertical dimension than that of said valve ring and wherein said one member is provided with upper valve ring restraining lugs arranged to limit the upward movement of said valve ring to a location below the upper end of said groove.

* * * * *